US010604316B2

(12) United States Patent
Park

(10) Patent No.: US 10,604,316 B2
(45) Date of Patent: Mar. 31, 2020

(54) ROLLING BAND FOR WRAPPING CLOTHING

(71) Applicant: So Yeon Park, Daejeon (KR)

(72) Inventor: So Yeon Park, Daejeon (KR)

( * ) Notice: Subject to any disclaimer, the term of this patent is extended or adjusted under 35 U.S.C. 154(b) by 0 days.

(21) Appl. No.: 15/326,581

(22) PCT Filed: Aug. 27, 2015

(86) PCT No.: PCT/KR2015/009003
§ 371 (c)(1),
(2) Date: Jan. 16, 2017

(87) PCT Pub. No.: WO2016/032262
PCT Pub. Date: Mar. 3, 2016

(65) Prior Publication Data

US 2017/0203897 A1 Jul. 20, 2017

(30) Foreign Application Priority Data

Aug. 28, 2014 (KR) ..... 10-2014-0112926

(51) Int. Cl.
*B65D 85/18* (2006.01)
*B65D 63/10* (2006.01)
(Continued)

(52) U.S. Cl.
CPC ..... *B65D 63/10* (2013.01); *A45C 3/004* (2013.01); *A45C 7/0059* (2013.01);
(Continued)

(58) Field of Classification Search
CPC .... B65G 85/18; B65G 85/182; A61B 19/045; A47G 25/54; A45C 3/12; A45C 3/00
(Continued)

(56) References Cited

U.S. PATENT DOCUMENTS

2004/0200044 A1* 10/2004 Lusardi ..... A45F 5/12 24/306
2006/0037874 A1* 2/2006 Mitchell ..... A47G 11/00 206/225
2007/0243784 A1* 10/2007 Shearrow ..... A47G 9/0284 442/320

FOREIGN PATENT DOCUMENTS

JP 3084664 12/2001
JP 2003-212205 7/2003
(Continued)

OTHER PUBLICATIONS

English translation of 20-2009-0007439.
(Continued)

*Primary Examiner* — Sue A Weaver
(74) *Attorney, Agent, or Firm* — Antonio Ha & U.S. Patent, LLC

(57) ABSTRACT

A rolling band for wrapping clothing is made of non-stick material. A first adhesive member is attached to the top surface of the rolling band, and a second adhesive member is attached to the bottom surface thereof. A clothing item is placed on the top surface of the rolling band and rolled together therewith to attach the second adhesive member and the first adhesive member to each other to firmly maintain the clothing in the rolled state, and thus as the first and second adhesive members adhere effectively to each other, due to self-adhesiveness without an adhesive agent, but not to the clothing, the wrapping work can be accomplished easily, quickly and without damage to the clothing, and as the wrapped clothing firmly maintains the rolled shape, the volume of the clothing is compressed, wrinkling and untidiness are prevented, and portability is facilitated.

6 Claims, 4 Drawing Sheets

(51) Int. Cl.
*B65D 75/54* (2006.01)
*A45C 3/00* (2006.01)
*A45C 7/00* (2006.01)

(52) U.S. Cl.
CPC ..... *A45C 7/0095* (2013.01); *B65D 75/54* (2013.01); *B65D 85/18* (2013.01)

(58) Field of Classification Search
USPC ..... 206/278, 225, 410; D3/299, 273
See application file for complete search history.

(56) References Cited

FOREIGN PATENT DOCUMENTS

| | | |
|---|---|---|
| KR | 10-2007-0094593 | 9/2007 |
| KR | 20-2009-0007439 | 7/2009 |
| KR | 10-1420577 | 7/2014 |

OTHER PUBLICATIONS

English translation of 3084664.
English translation of 2003-212205.
English translation of 10-2007-0094593.
English translation of 10-1420577.

* cited by examiner

ROLLING BAND FOR WRAPPING CLOTHING

CROSS-REFERENCE TO RELATED APPLICATIONS

This patent application is a national-stage application of PCT/KR2015/009003 which claims priority under 35 U.S.C. § 119 to Korean Patent Application No. 10-2014-0112926 filed on Aug. 28, 2014 in the Korean Intellectual Property Office, the disclosure of which is incorporated by reference herein in its entirety.

TECHNICAL FIELD

The present invention relates to rolling bands for wrapping clothing, and more specifically, to rolling bands for wrapping clothing allowing for a quick, safe, and convenient wrapping of clothes without damage and sucking together even when placed in the same space.

DISCUSSION OF RELATED ART

Generally, clothes are folded and stored for reducing their volume. The volume occupied by clothes in a storage space depend on how they are stored. Clothes may be stored folded or placed in vacuum bags to reduce volume.

There is a limit to reducing volume by manual folding. The use of vacuum bags requires a separate air suction means to remove the air therein.

Growing travel and outdoor activities led to increased demand for tools capable of efficiently and conveniently reducing the volume of clothes without the need for a separate air suction means.

A relevant technique is found in Korean Utility Model Application No. 20-2009-0007439 disclosing multi-purpose vinyl covers having the function of wrapping clothing and method for manufacturing the same to reduce the volume of clothes in an efficient manner. The idea therein is to roll a piece of clothing on a vinyl cover and fasten the same with a Velcro tape.

Such approach, however, may damage the piece of clothing due to friction against the Velcro tape while it is wrapped or unwrapped, and thus, an effort to avoid such damage would delay the wrapping process.

Moreover, storing several vinyl covers in the same space may cause their Velcro tapes to stick together in which case separating one from another is not easy, and in doing so, the user may be subject to skin scratches.

Further, opening the Velcro tape to unwrap the vinyl cover requires steadily placing a predetermined pressure of force, which would be hard work, particularly, to weak users, and causes noise that bothers the user.

PRIOR TECHNICAL DOCUMENTS

Patent Document (Patent Document 1) KR20-2009-0007439 U

SUMMARY

An object of the present invention is to provide a portable rolling hand for wrapping clothing allowing for a quick and convenient wrapping of clothing without damage while wrapping or unwrapping the clothing, which may keep the wrapped clothing in a secured position.

An object of the present invention is to provide a rolling band for wrapping clothing capable of easier, safer, and stick-free storage and maintenance even when multiple such rolling bands wrapping clothing are placed together in the same space.

An object of the present invention is to provide a rolling band for wrapping clothing that can be used without hard work and present significantly reduced noise when opening the Velcro tape.

According to the present invention, there is provided a rolling band 100 rolled together with a clothing item 10 to wrap the clothing item. The rolling band 100 is formed of a non-adhesive member. A self-adhesive first adhesive member 110 is attached to only one of both ends on an upper surface of the rolling band 100, and a self-adhesive second adhesive member 120 is attached to only one of both ends on a lower surface of the rolling band 100 which is positioned opposite the first adhesive member 110. The first adhesive member 110 and the second adhesive member 120 are attached to each other but not attached to the clothing item 10 and the non-adhesive member. The clothing item 10 is placed on an upper portion of the upper surface of the rolling band 100 and is rolled together with the tolling band 100 so that the first adhesive member 110 and the second adhesive member 120 attach each other to leave the clothing item in a fixed, rolled-up position, allowing the non-adhesive member to be positioned on an outer surface of the rolling band 100 upon rolling the clothing item 10.

Here, the second adhesive member 120 is formed to be longer than the first adhesive member 110.

On the other hand, according to the present invention, there is provided a rolling band 100 rolled together with a clothing item 10 to wrap the clothing item. The rolling band 100 is formed of self-adhesive vinyl. A first non-adhesive member 130 is attached to only one of both ends on an upper surface of the rolling band 100, and a second non-adhesive member 140 is attached to on only one of both ends on a lower surface of the rolling band 100 which is positioned opposite the first non-adhesive member 130. The first non-adhesive member 130 and the second non-adhesive member 140 are not attached to each other and are not attached to the clothing item 10. The first non-adhesive member 130 and the second non-adhesive member 140 are formed to occupy a portion of the rolling band 100. The clothing item 10 is placed on an upper portion of the upper surface or the lower surface of the rolling band 100 and is rolled together with the rolling band 100 so that both ends of the rolling band 100 attach each other to leave the clothing item 10 in a fixed, rolled-up position, allowing the non-adhesive member to be positioned on an outer surface of the roll band 100 upon rolling the clothing item 10.

Here, the first non-adhesive member 130 is formed to be longer than the second non-adhesive member 140.

Meanwhile, a fixing hole 150 is formed in at least one of both the ends of the rolling band 100 to allow the rolling band 100 to hang for storage purposes.

According to the present invention, the first adhesive member 110 and the second adhesive member 120, which have self-adhesive characteristics, can attach each other well without an adhesive, but do not stick to the clothing item 10, allowing the clothing item 10 to be wrapped in a quick and easier way. Further, the clothing item 10 wrapped may remain in a fixed, rolled-up position, leaving the clothing item 10 compressed in a reduced volume, wrinkle-free, and easier to carry.

Further, the first adhesive member 110 and the second adhesive member 120 are of the self-adhesive characteristic, eliminating the need for an adhesive, and even under repetitive use, they do not lose adhesivity for a long time, which allows for semi-permanent use.

Although a plurality of clothing items wrapped in rolling bands are placed in the same space, they do not stick together, allowing the user to separate them apart in an easier and safe manner.

Upon unwrapping the clothing item 10, separation of the first adhesive member 110 from the second adhesive member 120 can be done without hard work, causing remarkably reduced noise.

DETAILED DESCRIPTION OF EMBODIMENTS

Preferred embodiments of the present invention are hereinafter described with reference to the accompanying drawings in such a manner as to be easily practiced by one of ordinary skill in the art.

As used herein, the term "clothing item," in its meaning, includes a rollable item formed of a cloth or fabric, e.g., a piece of clothing or towel.

As used herein, the term "non-adhesive member" in its meaning includes a non-adhesive cloth or unwoven cloth.

First Embodiment

Figure 1:
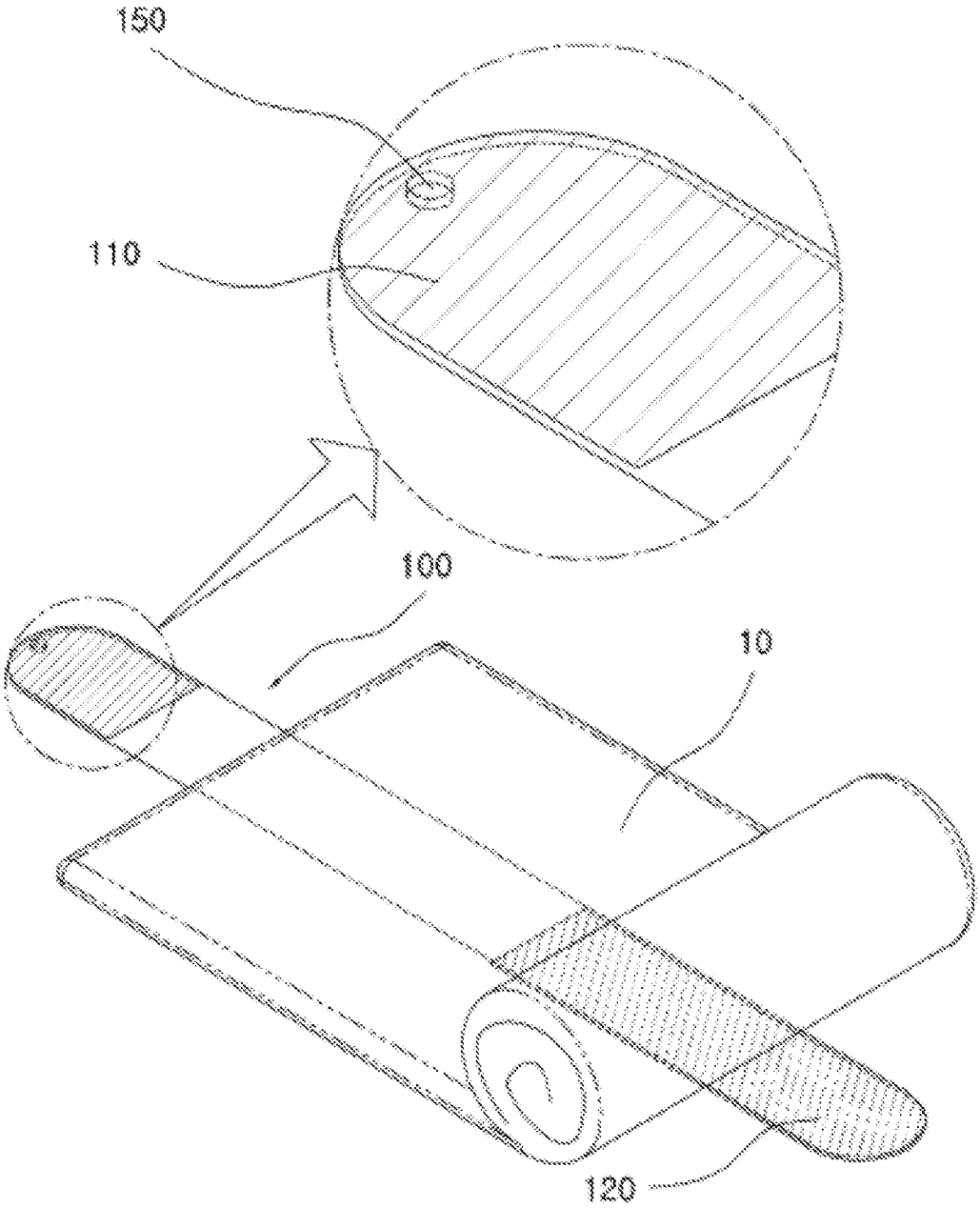
FIG. 1 is a perspective view illustrating a rolling band for wrapping clothing according to a first embodiment of the present invention.

FIG. 1 is a perspective view illustrating a rolling band for wrapping clothing according to an embodiment of the present invention.

Referring to FIG. 1, according to an embodiment of the present invention, a rolling band for wrapping clothing includes a rolling band 100 formed of a non-adhesive member. A first adhesive member 110 is attached on an upper surface of the rolling band 100, and a second adhesive member 120 is attached on a lower surface of the rolling band 100. A clothing item 10 is placed on an upper part of the upper surface of the rolling band 100, the clothing item 10, together with the rolling band 100, is rolled, and the first adhesive member 110 and the second adhesive member 120 are attached together, leaving the clothing item 10 in a rolled position.

The rolling band 100 is a piece of non-adhesive vinyl that is long and narrow. The non-adhesive vinyl may be replaced with an unwoven fabric or cloth.

The first adhesive member 110 formed of adhesive vinyl is attached onto an end of the upper surface of the rolling band 100. The first adhesive member 110 is attached on one of both ends on the upper surface of the rolling band 100. The first adhesive member 110 is securely attached onto the rolling band 100 by, e.g., sewing, an adhesive, an adhesive tape, high-frequency bonding, or ultrasonic bonding.

The first adhesive member 110 may be separated into a plurality of portions that may be attached to occupy a portion of the rolling band 100 as shown in FIG. 1 or attached to occupy the overall surface of a portion of the rolling band 100.

The second adhesive member 120 formed of adhesive vinyl is attached onto an end of the lower surface of the rolling band 100. The second adhesive member 120 is positioned at one of both ends on the lower surface of the rolling band 100 which is positioned opposite the first adhesive member 110.

For example, if the first adhesive member 110 is attached onto a front side of the upper surface of the rolling band 100, the second adhesive member 120 is attached onto a rear side of the lower surface of the rolling band 100.

The second adhesive member 120 may also be securely attached to the rolling band 100 by, e.g., sewing, an adhesive, an adhesive tape, high-frequency bonding, or ultrasonic bonding. The second adhesive member 120 may be separated into a plurality of portions to be attached to occupy a portion of the rolling band 100 or occupy the overall surface of a portion of the rolling band 100. The first adhesive member 110 and the second adhesive member 120 are formed to correspond in shape to each other when they are attached together.

Further, the second adhesive member 120 is formed to be longer than the first adhesive member 110, so that, although the second adhesive member 120 is rolled into the inside of the clothing item 10 when the clothing item 10 placed on the rolling hand 100 is rolled together with the rolling band 100, a predetermined portion of the second adhesive member 120 may be exposed and thus the second adhesive member 120 may smoothly be attached to the first adhesive member 110.

The first adhesive member 110 and the second adhesive member 120 may be self-adhesive films that may stick together without an adhesive or may be self-adhesive vinyl members that may stick together without an adhesive and that is firmed of a polyvinyl chloride (PVC) or ethylene-vinyl acetate copolymer (EVM) adhesive commercially available, and the first adhesive member 110 and the second adhesive member 120, unlike normal vinyl members, have the characteristic that they stick well with the same material but not with a different material. Further, the first adhesive member 110 and the second adhesive member 120, when touched by the user's hand or skin, leave no adhesive on the hand or skin because no adhesive is exposed to the outside, and although contacted by a different material of vinyl sheet, do not stick with the vinyl sheet.

In other words, the first adhesive member 110 and the second adhesive member 120 stick well each other, but the clothing item 10 does not stick with the first adhesive member 110 or second adhesive member 120. Hence, the clothing item 10 is not damaged while wrapped or unwrapped from the rolling band 100.

A through-hole, as a fixing hole, is formed in one of both ends of the rolling band 100, allowing the rolling band 100 to hang on a nail or hook therethrough.

Now described are operations of a rolling band for wrapping clothing according to an embodiment of the present invention.

Figure 2:
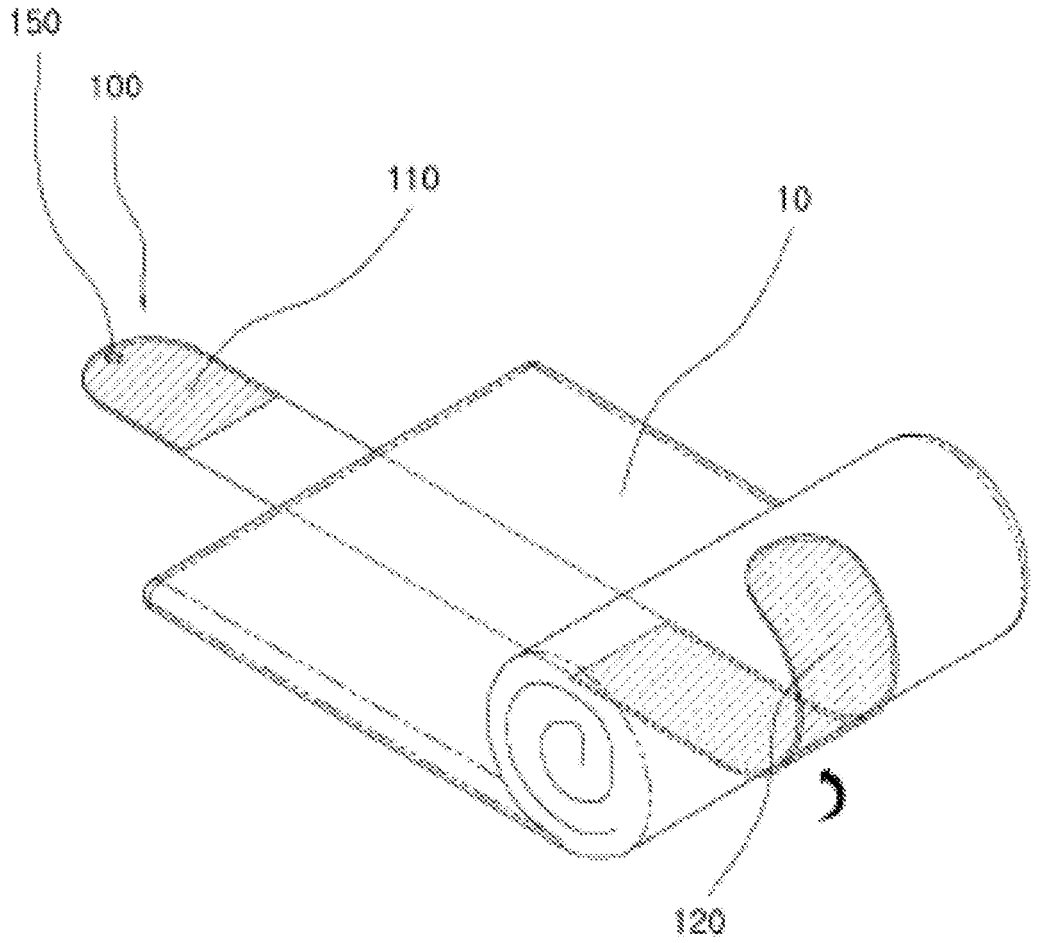
FIG. 2 is a perspective view illustrating an example of rolling a clothing item 10, along with a rolling band for wrapping clothing, according to the first embodiment of the present invention.
Figure 3:
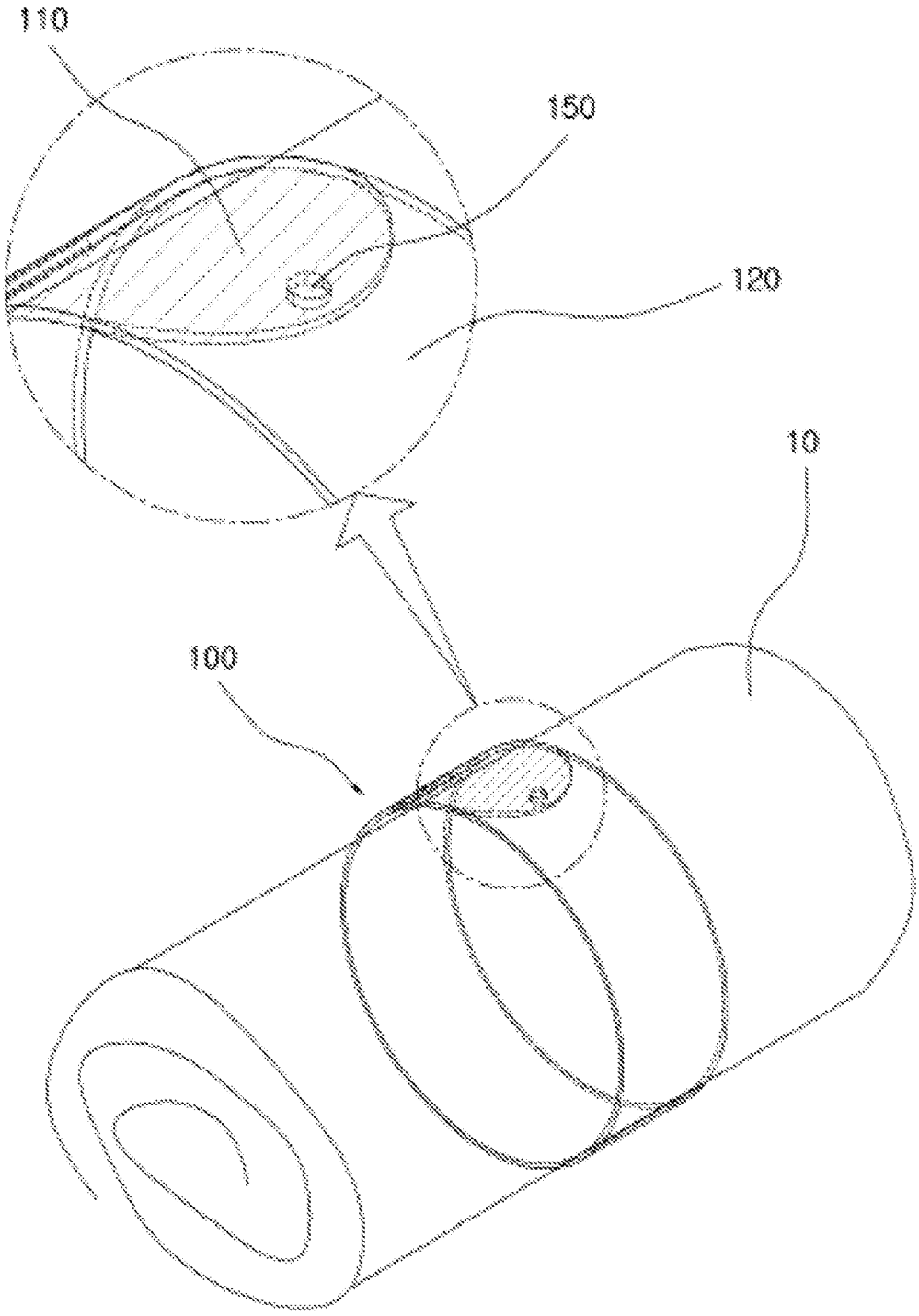
FIG. 3 is a perspective view illustrating an example in which a clothing item 10 is in a position wrapped up with a rolling band of wrapping clothing according to the first embodiment of the present invention.

FIG. 1 is a perspective view illustrating a rolling band for wrapping clothing according to an embodiment of the present invention. FIG. 2 is a perspective view illustrating an example of rolling a clothing item 10, along with a rolling band for wrapping clothing, according to a first embodiment of the present invention. FIG. 3 is a perspective view illustrating an example in which a clothing item 10 is in a position wrapped up with a rolling hand of wrapping clothing according to the first embodiment of the present invention.

A clothing item 10 is placed on an upper portion of the upper surface of the rolling band 100 as shown in FIG. 1.

Then, as shown in FIG. 2, the second adhesive member 120 side in the rolling band 100, together with the clothing member 10, is rolled towards the first adhesive member 110. The second adhesive member 120 positioned on the lower surface of the rolling band 100 is then exposed upwards as the rolling band 100 is rolled. Since the second adhesive member 120 is longer than the first adhesive member 110, although the second adhesive member 120 is rolled together with the clothing item 10, mere a portion of the second adhesive member 120 is rolled into the inside of the clothing item 10, and a predetermined portion of the rest of the second adhesive member 120 is exposed upwards.

As the rolling band 100 continues to be rolled, the clothing item 10 is rolled up and is thus positioned in the inside of the rolling band 100 as shown in FIG. 3, with an end of the rolling band 100 meeting the second adhesive member 120. In other words, the first adhesive member 110 meets the second adhesive member 120.

As the rolling band 100 is rolled along with the clothing item 10, the second adhesive member 120 is overturned and exposed upwards and comes in contact with the first adhesive member 110. The user presses the first adhesive member 110 so that the first adhesive member 110 and the second adhesive member 120 attach each other. Then, the clothing item 10 remains secured in the rolled-up position by the rolling band 100, allowing it to be easily carriable.

As set forth above, the first adhesive member 110 and the second adhesive member 120 stick well each other but not with a different material or substance and are thus prevented from sticking to the clothing item 10, protecting the clothing item 10 against damage.

In addition to preventing damage to the clothing item 10, there is no need for a separate vacuum suction tool, allowing the clothing item 10 to be compressed in a quick and easy manner.

After the rolling of the rolling band 100 is done, the first adhesive member 110 and the second adhesive member 120 are positioned on the inside of the rolling band 100 or towards the clothing item and are thus subject to little or no exposure to the outside. Thus, although multiple clothing items 10 wrapped in the rolling bands are placed in the same space, such an issue does not arise that the adhesive members stick together, and no need exists for the user to forcedly separate them apart, preventing damage to the user and resultantly allowing safe use.

By detaching the first adhesive member 110 and the second adhesive member 120 from each other, the clothing item 10 may be unwrapped in which case less power is used to do so, and noise is remarkably reduced.

Such rolling bands 100 may be used for wrapping or packing clothing for display in clothing shops or are also available for home use to organize out-of-season clothes.

Second Embodiment

Figure 4:
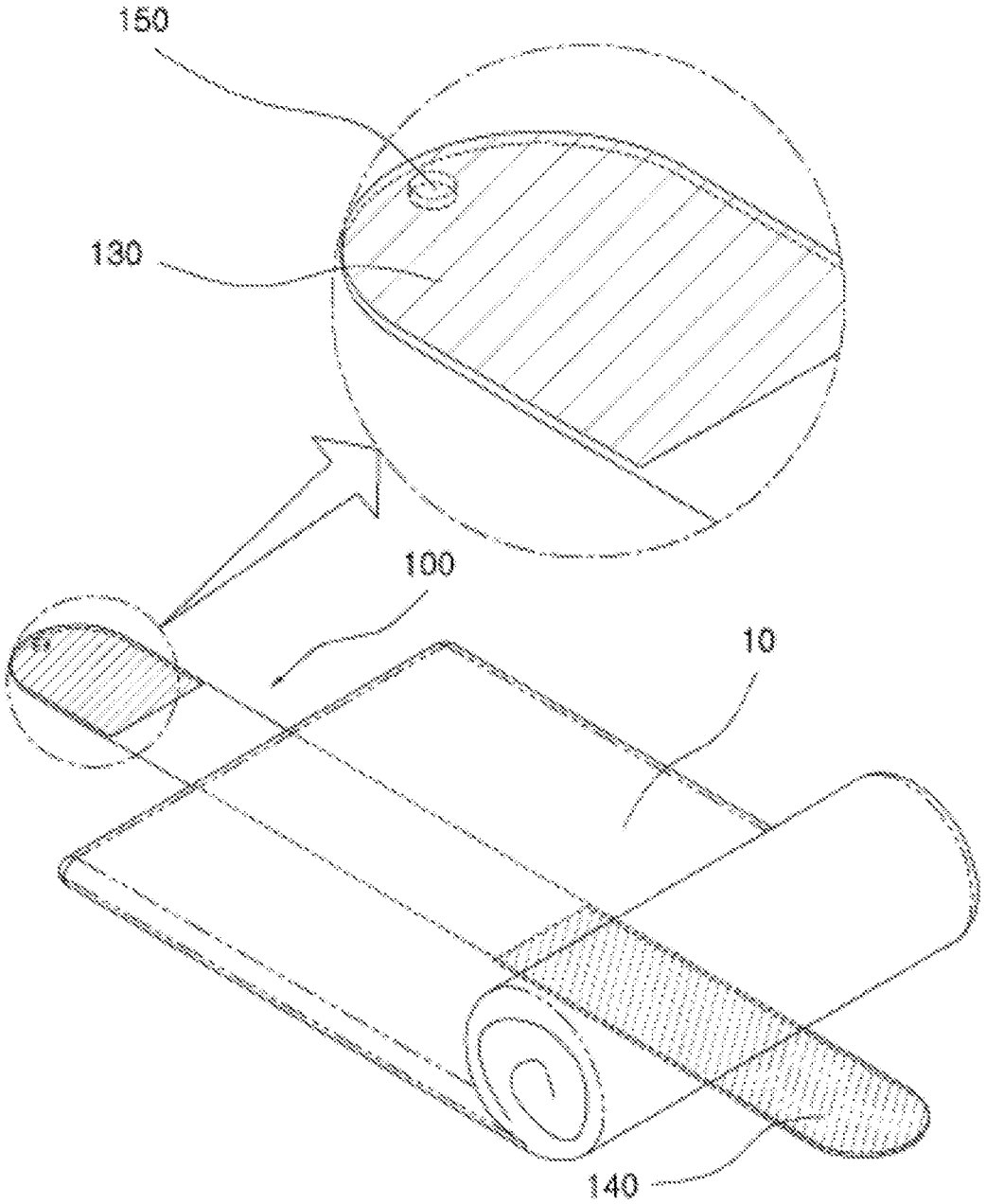
FIG. 4 is a perspective view illustrating a rolling band for wrapping clothing according to a second embodiment of the present invention.

FIG. 4 is a perspective view illustrating a rolling band for wrapping clothing according to a second embodiment of the present invention.

Referring to FIG. 4, according to the second embodiment of the present invention, the rolling band 100 for wrapping clothing is formed of self-adhesive vinyl.

A first non-adhesive member 130, instead of the first adhesive member 110, is attached on the upper surface of the rolling band, and a second non-adhesive member 140, instead of the second adhesive member 120, is attached on the lower surface of the rolling band 100 (refer to FIG. 1). The self-adhesive vinyl of the rolling band 100 is the same material as the first adhesive member 110 and the second adhesive member 120 according to the first embodiment.

The second embodiment of the present invention encompasses the first embodiment, and the same components as those in the first embodiment are avoided from the detailed description that primarily focuses on differences from the first embodiment.

In contrast to the first embodiment, according to the second embodiment, the material of the rolling band 100 is changed from the non-adhesive member to self-adhesive vinyl so that the first non-adhesive member 30 and the second non-adhesive member 140 each are attached to the rolling band 100.

The rolling band 100 is a piece of self-adhesive vinyl that is long and narrow. Both the upper and lower surface of the rolling band 100 are formed of self-adhesive vinyl. The first non-adhesive member 130 is attached onto an end of the upper surface of the rolling band 100. The first non-adhesive member 130 is positioned at one of both ends on the upper surface of the rolling band 100. The first non-adhesive member 130 may securely be attached to the rolling band by, e.g., sewing, an adhesive, an adhesive tape, high-frequency bonding, or ultrasonic bonding.

The first non-adhesive member 130 may be separated into several portions as shown in FIG. 4 to be attached to occupy a portion of the rolling band 100, or may, without such separation, be attached onto a portion of the rolling band 100.

The second non-adhesive member 140 is attached onto an end of the lower surface of the rolling band 100. The second non-adhesive member 140 is positioned at one of both ends on the lower surface of the rolling band 100 and opposite the first non-adhesive member 130.

For example, if the first non-adhesive member 130 is positioned on a front side of the upper surface of the rolling band 100, the second non-adhesive member 140 is positioned on a rear side of the lower surface of the rolling band 100.

The second non-adhesive member 140 may also be securely attached to the rolling band by, e.g., sewing, an adhesive, an adhesive tape, high-frequency bonding, or ultrasonic bonding and may be separated into several portions to be attached to occupy a portion of the rolling band 100, or may, without such separation, be attached onto a portion of the rolling band 100.

Further, the first non-adhesive member 130 and the second non-adhesive member 140 are formed so that the self-adhesive vinyl of the rolling band 100 does not stick to the self-adhesive vinyl of an adjacent rolling band 100 when the clothing item 10 is rolled up with the rolling band 100.

In wrapping the clothing item 10 with the rolling band 100 according to the second embodiment, the self-adhesive vinyl present on the opposite surface of where the rolling band 100 comes in double contact with the non-adhesive members is exposed. Thus, when the rolling band 100, together with the clothing item 10, is rolled up, the self-adhesive vinyl portions exposed at both ends of the rolling band 100 attach each other in a larger area, leaving the clothing item 10 in a secured rolled-up position (see FIG. 3—the rolling band 100, along with the clothing item 10, is rolled in the same manner as shown in FIG. 3).

[Description of symbols]

| | |
|---|---|
| 10: Clothing item | |
| 100: Rolling band | |
| 110: First adhesive member | 120: Second adhesive member |
| 130: First non adhesive member | 140: Second non-adhesive member |
| 150: Fixing hole | |

What is claimed is:

1. A rolling band rolled together with a clothing item to wrap the clothing item, wherein the rolling band is formed of a non-adhesive member smaller in width than the clothing item, wherein a self-adhesive first adhesive member is attached to only one of both ends on an upper surface of the rolling band, and a self-adhesive second adhesive member is attached to only one of both ends on a lower surface of the rolling band which is positioned opposite the first adhesive member, wherein the first adhesive member and the second adhesive member are attached to each other but not attached to the clothing item and the non-adhesive member, wherein the clothing item is placed on an upper portion of the upper surface of the rolling band and is rolled together with the rolling band so that the first adhesive member and the second adhesive member attach each other to leave the clothing item in a fixed, rolled-up position, allowing the non-adhesive member to be positioned on an outer surface of the rolling band upon rolling the clothing item, and wherein the first adhesive member and the second adhesive member are self-adhesive films that stick together without an adhesive and are formed of polyvinyl chloride (PVC) or ethylene-vinyl acetate copolymer (EVM).

2. The rolling band of claim 1, wherein the second adhesive member is formed to be longer than the first adhesive member.

3. The rolling band of claim 1, wherein a fixing hole is formed in at least one of both the ends of the rolling band to allow the rolling band to hang for storage.

4. A rolling band rolled together with a clothing item to wrap the clothing item, wherein the rolling band is formed of self-adhesive vinyl smaller in width than the clothing item, wherein a first non-adhesive member is attached to only one of both ends on an upper surface of the rolling band, and a second non-adhesive member is attached to only one of both ends on a lower surface of the rolling band which is positioned opposite the first non-adhesive member, wherein the first non-adhesive member and the second non-adhesive member are not attached to each other and are not attached to the clothing item, wherein the first non-adhesive member and the second non-adhesive member are formed to occupy a portion of the rolling band, and wherein the clothing item is placed on an upper portion of the upper surface or the lower surface of the rolling band and is rolled together with the rolling band so that both ends of the rolling band attach each other to leave the clothing item in a fixed, rolled-up position, allowing the non-adhesive member to be positioned on an outer surface of the rolling band upon rolling the clothing item.

5. The rolling band of claim 4, wherein the first non-adhesive member is formed to be longer than the second non-adhesive member.

6. The rolling band of claim 4, wherein a fixing hole is formed in at least one of both the ends of the rolling band to allow the rolling band to hang for storage.

* * * * *